United States Patent [19]

Uchida et al.

[11] Patent Number: 4,631,152

[45] Date of Patent: Dec. 23, 1986

[54] HUMIDIFIER

[75] Inventors: Tetsuei Uchida; Tsutomu Uchida; Nobuo Tsuchida; Susumu Kazama, all of Sanjo, Japan

[73] Assignee: Uchida Manufacturing Co., Niigata, Japan

[21] Appl. No.: 789,763

[22] Filed: Oct. 21, 1985

[30] Foreign Application Priority Data

Mar. 6, 1985 [JP] Japan ..... 60-32446[U]

[51] Int. Cl.[4] ..... B01F 3/04

[52] U.S. Cl. ..... 261/4; 210/282; 210/287; 261/81; 261/DIG. 48; 261/DIG. 46; 261/72 R

[58] Field of Search ..... 261/DIG. 46, DIG. 48, 261/81, 72 R, 4; 210/282, 287

[56] References Cited

U.S. PATENT DOCUMENTS 3,126,335 3/1964 Stipe ..... 210/287
3,430,769 3/1969 Sanzenbacher ..... 210/282
4,031,171 6/1977 Asao et al. ..... 261/1
4,257,989 3/1981 Nishikawa ..... 261/DIG. 48
4,409,105 10/1983 Hayashi et al. ..... 210/287
4,563,313 1/1986 Tsuaki ..... 261/DIG. 48

FOREIGN PATENT DOCUMENTS 57-36976 2/1982 Japan .

*Primary Examiner*—Tim Miles
*Attorney, Agent, or Firm*—Cushman, Darby & Cushman

[57] ABSTRACT

A household humidifier comprising a closed water tank, a demineralizer, an air exchange pipe for introducing the outside air, a housing defining a chamber, and a coiled spring. The demineralizer has a container containing ion-exchange resin. The water tank has a water supply port through which the demineralizer and the air exchange pipe can be inserted into the tank. One hollow end of the container is rotatably connected to the chamber such that the container is in communication with the chamber. The container is biased downward by the spring so that the container always lies on its side.

4 Claims, 5 Drawing Figures

HUMIDIFIER

FIELD OF THE INVENTION

The present invention relates to improvements in a household humidifier equipped with a demineralizer for removing inorganic substances, such as potassium and magnesium, from water.

BACKGROUND OF THE INVENTION

Humidifiers of this kind have been well known and disclosed as in Japanese Utility Model Publication No. 36976/1982 and Japanese Utility Model application No. 189621/1984 that was filed by the present applicant. In a conventional humidifier of this type, a demineralizer is mounted in a water tank, and therefore the whole structure is compact. Further, the air inside the water tank is smoothly exchanged with the outside air through an air exchange pipe. This makes it easy to drop the water inside the tank to a saucer. In addition, it is easy to mount and withdraw the demineralizer through the water supply port in the water tank. It is not necessary to form a further port to mount the demineralizer into the tank. This introduces the advantage that locations at which water leaks are few.

However, the conventional humidifier constructed as described above has disadvantages. Specifically, the container of the demineralizer or the portion to be connected to the housing of the demineralizer is made from a flexible synthetic resin. Further, the specific gravity of the ion-exchange resin is smaller than that of water. Therefore, when the demineralizer is introduced into the water tank, the container of the demineralizer may not certainly lie on its side in position on the bottom of the tank. Thus, the container may rock within the water or even float on the water. Since it is difficult to cause the container of the demineralizer to lie on its side in position, water cannot be stably supplied from the water tank through the demineralizer to the saucer.

SUMMARY OF THE INVENTION

In view of the foregoing disadvantages with the prior art device, it is the object of the present invention to provide a humidifier which has the same advantages as the aforementioned prior art humidifier, yet allows the container of a demineralizer to be certainly and stably placed in position on the bottom of a water tank, whereby water can be supplied from the tank through the demineralizer to a saucer.

The above object is achieved by a humidifier comprising: a closed water tank detachably mounted on the body of the humidifier; a demineralizer having a container containing ion-exchange resin; an air exchange pipe for introducing the outside air; the water tank having a water supply port through which the demineralizer and the air exchange pipe can be inserted into the water tank; a housing disposed below the container of the demineralizer and defining a chamber, one hollow end of the container of the demineralizer being rotatably connected to the chamber such that the container is in communication with the chamber; and a resilient means for always causing the container of the demineralizer to lie on its side.

BRIEF DESCRIPTION OF THE DRAWINGS

FIG. 5 is a cross-sectional view of the conventional humidifier, and in which a demineralizer is mounted in a water tank.

DESCRIPTION OF THE PREFERRED EMBODIMENT

Figure 1:
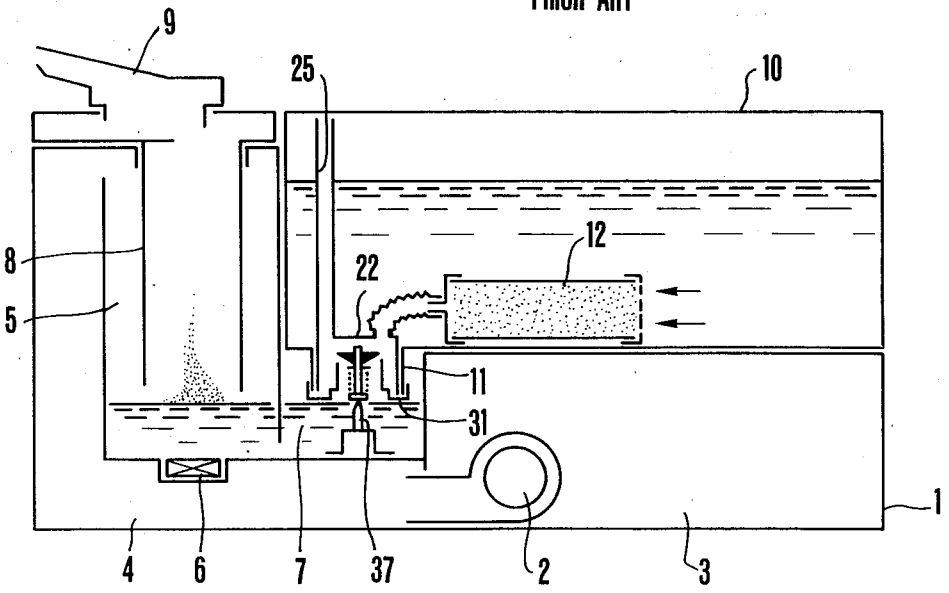
FIG. 1 PRIOR ART
FIG. 1 is a cross-sectional view of the whole structure of a humidifier, for illustrating the principles of a conventional humidifier and of the invention.

Referring first to FIG. 1, there is shown a humidifier, the body of which is indicated by reference numeral 1. The body 1 is made from a synthetic resin and has a substantially L-shaped cross section. The inside of the body is partitioned into a chamber 3 in which electrical components including a blower 2 are housed and an atomizing chamber 5. This atomizing chamber 5 is in communication with the chamber 3 through a wind channel 4 so that air flow is supplied from the blower 2 into the atomizing chamber 5. A vibrating device 6 is mounted on the bottom of the atomizing chamber 5 to atomize water by ultrasonic waves. The atomizing chamber 5 is in communication with a saucer 7 to which water is dropped, the saucer 7 being disposed between the atomizing chamber 5 and the chamber 3.

Inside the atomizing chamber 5, a spray guide cylinder 8 depends from above to a position close to the water surface. The upper portion of the cylinder 8 is connected to an atomizing duct 9 that can face in any direction. A closed, boxlike water tank 10 is made from a transparent synthetic resin, and has a water supply port 11 at the bottom at its one end. The wall of the port 11 has been threaded. A demineralizer 12 is entirely made from a synthetic resin.

Figure 2:
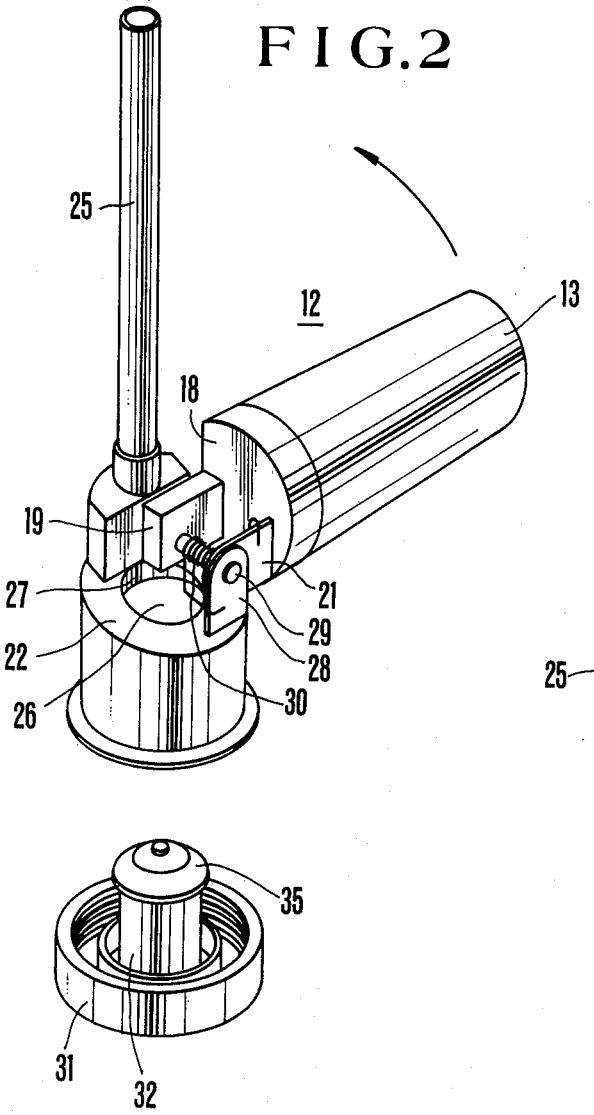
FIG. 2 is a perspective view of a demineralizer and a water intake port cap according to the invention.
Figure 3:
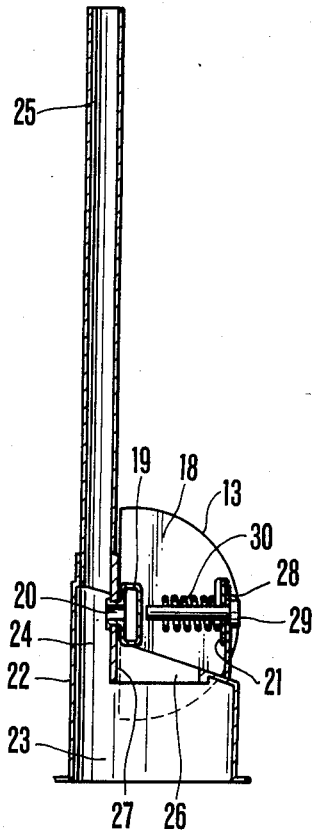
FIG. 3 is a longitudinal cross section of the demineralizer shown in FIG. 2.
Figure 4:
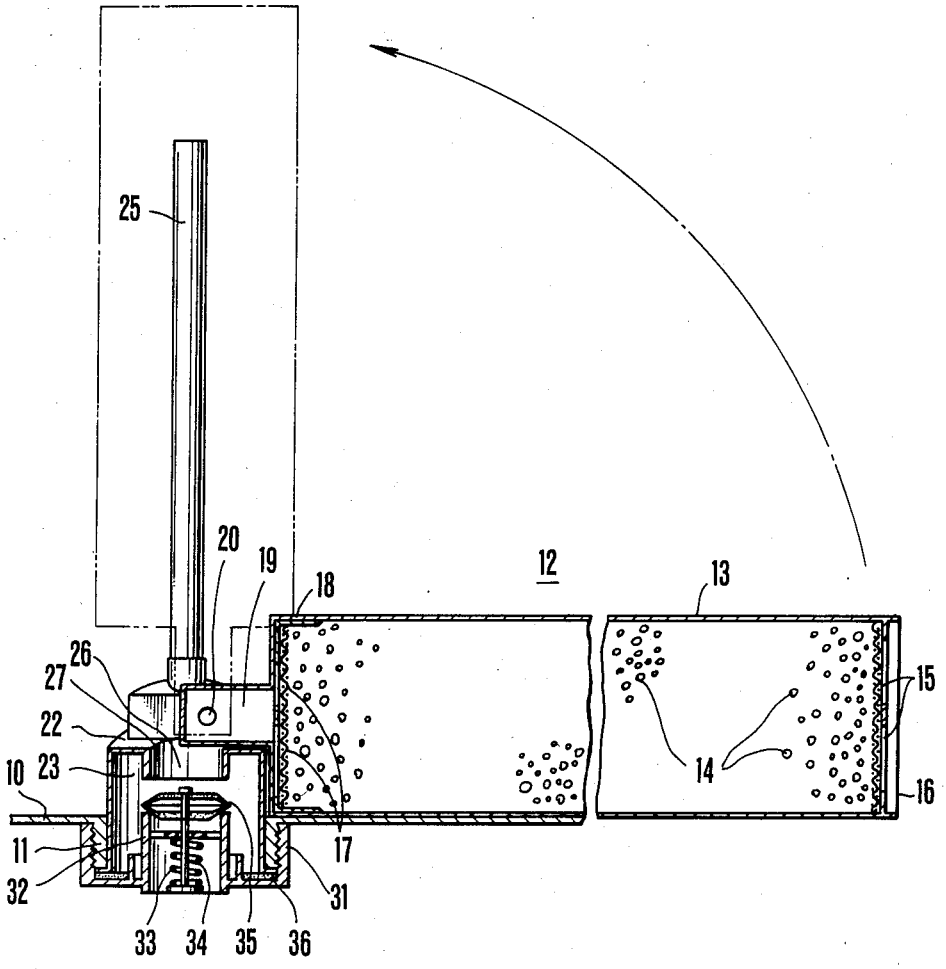
FIG. 4 is a cross-sectional view of a humidifier according to the invention, and in which the demineralizer is mounted in a water tank.

Referring also to FIGS. 2–4, the demineralizer 12 has a semicylindrical container 13 that does not allow water to penetrate it. The diameter of the container 13 is less than the inside diameter of the water supply port 11. The length of the container 13 is set less than the height of the water tank 10. The container 13 is filled with particulate ion-exchange resin 14, and is entirely sealed so as not to allow the resin to escape. A water intake port 16 is formed at one opening of the container 13, and is covered by a net of very small meshes, indicated by 15. The other opening is covered by a net of very small meshes, indicated by 17. A cover 18 acting as a water supply port is detachably and fitly mounted to the outside of the latter net. One end surface of the cover 18 is flat, and a hollow protrusion 19 extends from a location close to this flat end. The protrusion 19 is smaller in diameter than the container 13. A protruding pivot 20 opens into one side of the protrusion 19. A support plate 21 protrudes from a location close to the round end surface of the cover 18 and extends parallel to the protrusion 19. When the ion-exchange resin 14 is exchanged with other, the container 13 is separated from the cover 18, and then another container 13 containing other ion-exchange resin is attached to the cover. Accordingly, it is not necessary to replace the whole demineralizer 12 with another.

The demineralizer further has a housing 22 made from a synthetic resin. The diameter of the housing 22 is slightly smaller than that of the water supply port 11 and resembles an inverted cup. A chamber 23 is formed inside the housing 22. The fringe around the bottom opening of the housing 22 is bent outward to form a flange. The upper surface of the housing 22 is inclined in one direction. A water intake port 24 that also acts as an air supply port is formed on the inner side of the top position of the inclined upper surface. One side wall of the water intake port 24 is provided with a hole in which the pivot 20 of the protrusion 19 of the cover 18 is fitted. The pivot 20 is in communication with the chamber 23 inside the housing. The protrusion 19 and the cover 18 are mounted to the housing so as to be rotatable in the direction indicated by the arrows shown in FIGS. 2 and 4. When the container 13 is placed so as to lie on its side, the end surface of the cover 18 is supported by one side surface of the housing 22. Then, the container 13 can no longer rotate downwardly (FIG. 4).

An air exchange pipe 25 protrudes vertically upwardly from the top of the water intake port 24 and reaches or almost reaches the inner surface of the top end of the water tank 10. The top end of the pipe 25 is cut obliquely and open.

A valve port 26 is formed substantially at the center of the top surface of the housing 22. The inner fringe of the port 26 is bent downwardly to form a valve seat 27. A water inlet port cap 31 (described later) has a valve 35. Usually, the water tank 10 is mounted on the body 1 of the humidifier. Under this condition, the valve port 26 is closed by the valve 35. A pivotal plate 28 extends vertically upwardly from the position that is on the opposite side of the water intake port 24 from the valve port 26. The plate 21 supporting the cover 18 is pivotally mounted to the pivotal plate 28 via the support pin 29. The container 13 is also pivotally mounted at the pivot 20 of the protrusion 19. Thus, the container is supported at two locations. A resilient means 30, such as a coiled spring, is mounted on the support pin 29. One end of the resilient means 30 is anchored to the pivotal plate 28, while the other end is retained to the support plate 21. The resilient means 30 always causes the container 13 to lie on its side or urges it downward. It is possible to rotate the container 13 against the action of the resilient means 30 by raising the container 13 with a hand. When the container 13 is rotated upward in opposition to the action of the resilient means 30 until it is parallel to the air exchange pipe 25, the outside diameter of the cover 18 is equal to or somewhat less than the outside diameter of the housing 22 of the humidifier, and is less than the diameter of the water supply port 11.

The aforementioned water intake port cap 31 is made from a synthetic resin and detachably screwed into the outer side of the water intake port 11 to seal the water tank 10. A hollow valve seat 32 protrudes from the center of the cap 31. Mounted inside the valve seat 32 is an operating pin 34 that is always forced to protrude downward by a spring 33. Mounted above the pin 34 is a valve 35 which is usually caused to close the upper end of the valve seat 32 by the action of the spring 33. A packing 36 is used to bring the front end of the water intake port 11 into intimate contact with the flange at the lower end of the housing 22.

When the cap 31 is mounted to the water tank 10, the tank is turned upside down, and then water is introduced into it. Thereafter, the container 13 of the demineralizer 12 is rotated upward against the action of the resilient means 30 until it is disposed parallel to the air exchange pipe 25. Under this condition, the housing 22 and the air exchange pipe 25 with the container 13 attached thereto are inserted from the water intake port 16 through the water supply port 11. Thereafter, the flange of the housing 22 of the demineralizer is caused to bear on the wall around the water supply port 11. At this time, the container 13 lies on its side and is restored to its original condition on the bottom of the tank 10 by the resilient means 30. In this case, since the tank 10 is turned upside down, the container is located at a higher position.

Then, the water intake port cap 31 is screwed into the water supply port 11 to seal the tank 10 while holding the whole demineralizer 12. Subsequently, the tank 10 is restored to its non-inverted posture. Indicated by numeral 37 is a push pin which extends vertically upwardly and is disposed opposite to the operating pin 34 of the cap 31 located above the pin 37.

In the operation of the humidifier constructed as described above, the water tank 10 is mounted on the body 1. Then, the operating pin 34 of the cap 31 is pushed up by the pin 37 in substantially the same way as in the conventional humidifier. This upwardly motion moves the valve 35 away from the valve seat 32, opening the valve port 26. At the same time, the valve 35 is seated on the valve seat 27 of the housing 22. Thus, water flows from the tank 10 to the saucer 7 through the water inlet port 16 of the demineralizer 12, the ion-exchange resin 14, the protrusion 19, the pivot 20, the water inlet port 24, the chamber 23, and the valve seat 32 until a certain amount of water is stored. During this process, inorganic substances are removed. At the same time, the outside air flows into the water tank 10 in the opposite direction through the valve seat 32 of the cap 31, the chamber 23, the water inlet port 24, and the air exchange pipe 25. This permits water to flow down smoothly.

The vibrating device 6 serves to atomize water, the resultant mist being released into the room through the atomizing duct 9. Thus, an appropriate amount of moisture is given to the air inside the room. Although the demineralizer 12 is made of a synthetic resin and filled with the ion-exchange resin both of which are less than water in specific gravity, the container 13 of the demineralizer 12 is certainly placed so as to lie on its side on the bottom of the tank 10 by the resilient force of the resilient means 30. Consequently, water can be stably supplied to the saucer 7 after being sufficiently filtered by the ion-exchange resin 14 inside the demineralizer 12. In the past, it has not been assured that the demineralizer 12 lies on its side in position. Rather, it would have rocked in water. In the worst case, the side of the container 13 containing the water inlet port 16 would have floated. In accordance with the prior art techniques, therefore, it has not been always possible to stably supply water from the demineralizer 12 to the saucer 7.

When water is supplied into the water tank 10 while the demineralizer 12 is mounted to the tank 10, the cap 31 is removed from the water supply port 11 while the tank 10 is maintained in its inverted posture. This opens both the valve port 26 in the housing 22 and the water inlet port 24 that acts also as the air intake port of the air exchange pipe 25, thus increasing the area through which air is exchanged with water. Hence, water can be smoothly supplied into the tank 10.

As described thus far, the novel humidifier comprises: the closed tank 10 detachably mounted on the body 1; the demineralizer 12 having the container 13 containing the ion-exchange resin 14; the air exchange pipe 25 for introducing the outside air; the water tank 10 having the water supply port 11 through which the demineralizer 12 and the air exchange pipe 25 can be inserted into the tank 10; the housing 22 disposed below the container 13 of the demineralizer 12 and defining the chamber 23, one hollow end of the container of the demineralizer 12 being rotatably connected to the chamber 23 such that the container is in communication with the chamber; and the resilient means 30 for always causing the container 13 of the demineralizer 12 to lie on its side. Therefore, the novel humidifier has the same advantages as the prior art humidifier of this kind. In addition, the container of the demineralizer can be placed in position on the bottom of the water tank certainly and stably. Consequently, water can be stably supplied from the water tank to the saucer through the demineralizer.

What is claimed is:

1. A humidifier comprising:

a closed water tank detachably mounted on the body of the humidifier;

a demineralizer having a container containing ion-exchange resin;

an air exchange pipe for introducing the outside air;

the water tank having a water supply port through which the demineralizer and the air exchange pipe can be inserted into the water tank;

a housing disposed below the container of the demineralizer and defining a chamber, one hollow end of the container of the demineralizer being rotatably connected to the chamber such that the container is in communication with the chamber; and a resilient means for always causing the container of the demineralizer to lie on its side.

2. A humdifier as set forth in claim 1, wherein the resilient means is a coiled spring.

3. A humidifier as set forth in claim 2, wherein one end of the coiled spring is fixed to the housing, while the other end is fixed to a plate rigidly fixed to the container of the demineralizer.

4. A humidifier as set forth in claim 3, wherein said plate is pivoted to the housing so that the container can be rotated upwardly against the action of the coiled spring.

* * * * *